US006409075B1

(12) United States Patent
Mehta et al.

(10) Patent No.: US 6,409,075 B1
(45) Date of Patent: Jun. 25, 2002

(54) MAILER INTERMEDIATE

(75) Inventors: Rajendra Mehta, Centerville; Todd M. Pegler, Dayton; Stephen W. Henson, Centerville; David E. Washburn, Kettering, all of OH (US)

(73) Assignee: The Standard Register Company, Dayton, OH (US)

( * ) Notice: Subject to any disclaimer, the term of this patent is extended or adjusted under 35 U.S.C. 154(b) by 0 days.

(21) Appl. No.: 09/678,888

(22) Filed: Oct. 4, 2000

(51) Int. Cl.[7] ..... B65D 27/00

(52) U.S. Cl. ..... 229/92.1; 283/101; 283/106

(58) Field of Search ..... 229/92.1, 92.3, 229/92.8, 305; 462/26; 283/116, 61, 101, 106

(56) References Cited

U.S. PATENT DOCUMENTS

| | | | | | |
|---|---|---|---|---|---|
| 3,197,121 | A | * | 7/1965 | Hayes, Jr. | 229/80.5 X |
| 3,826,422 | A | | 7/1974 | Dickinson | |
| 3,837,565 | A | | 9/1974 | Johnsen | |
| 3,905,545 | A | | 9/1975 | Juszak et al. | |
| 4,148,430 | A | | 4/1979 | Drake | |
| 4,625,909 | A | | 12/1986 | Ferrando | |
| 4,706,878 | A | * | 11/1987 | Lubotta et al. | 229/92.3 X |
| 4,776,510 | A | | 10/1988 | Jenkins | |
| 4,934,536 | A | | 6/1990 | Mills | |
| 5,064,071 | A | * | 11/1991 | Kerfoot, Jr. | 383/39 X |
| 5,201,464 | A | * | 4/1993 | File | 229/303 |
| 5,320,387 | A | | 6/1994 | Carlson | |
| 5,360,159 | A | * | 11/1994 | Perriman | 229/80.5 X |
| 5,377,904 | A | | 1/1995 | Michlin et al. | |
| 5,418,205 | A | | 5/1995 | Mehta et al. | |
| 5,421,620 | A | | 6/1995 | Sauerwine | |
| 5,431,337 | A | | 7/1995 | Bell | |
| 5,467,917 | A | | 11/1995 | Potter | |
| 5,797,541 | A | * | 8/1998 | Stenner | 229/92.8 |
| 5,862,978 | A | | 1/1999 | Forrest | |
| 5,893,512 | A | * | 4/1999 | Diedrich | 229/92.1 |
| 5,997,457 | A | * | 12/1999 | Stenner | 229/92.8 X |
| 6,095,919 | A | * | 8/2000 | Fabel | 462/26 X |
| 6,158,651 | A | * | 12/2000 | Mehta et al. | 229/92.1 |
| 6,248,049 | B1 | * | 6/2001 | Scheggetman | 493/188 |
| 6,276,601 | B1 | * | 8/2001 | Ross et al. | 229/305 |

* cited by examiner

*Primary Examiner*—Jes F. Pascua
(74) *Attorney, Agent, or Firm*—Killworth, Gottman, Hagan & Schaeff LLP

(57) ABSTRACT

A mailer intermediate is formed from a sheet having at least one transverse fold line dividing the sheet into a first panel and a second panel such that the first panel longitudinal dimensions are equal to, or exceed the second panel longitudinal dimensions. The second panel is folded over onto the first panel. A temporary tacking agent is applied to the face of the sheet to temporarily tack down the folded over, transverse edge of the lower panel. The mailer intermediate may be processed in this pre-folded condition according to the user's variable imaging needs because there are no loose edges to catch in printer output stacking trays, or jam in internal components of printers. The longitudinal edges of the return envelope panel may be permanently sealed prior to printing, or may be sealed later during processing through folder/sealer equipment.

34 Claims, 7 Drawing Sheets

MAILER INTERMEDIATE

BACKGROUND OF THE INVENTION

The present invention relates in general to a mailer, and more particularly to a mailer intermediate with a return envelope panel.

Mailers are commonly used as an effective way to distribute information including bills, statements, and advertisements. One mailer construction includes folding a sheet into three generally rectangular panels, including an upper, middle and lower panel. The lower panel is folded over onto the middle panel, and sealed to the middle panel adjacent to the opposite side edges forming a pocket. The upper panel is folded over onto the lower panel, such that the mailer forms a "C" pattern. This is referred to as a C-fold mailer. Alternatively, the upper panel may be folded back against the middle panel such that the mailer is fan folded or forms a "Z" pattern. This is referred to as a Z-fold mailer. A third mailer, the "V" fold includes only two panels, and is usually folded in half. Where a mailer has not been subjected to all of the steps necessary for its completion, including user-variable printing, folding, sealing or the like, the mailer may be referred to as a mailer intermediate.

Unfortunately, printing a mailer intermediate with a pre-formed return envelope panel, using common sheet feed print devices such as laser and ink jet printers, is difficult. For example, such mailer intermediates are difficult to stack. This problem becomes most apparent when the mailers are stacked face up. Edges, such as those formed by pockets, partially glued on panels, or fold edges, can catch on printer mechanisms causing the printer to jam. Likewise, these edges can catch on other mailer intermediates in the feed trays or output stacking trays. Further, loose edges can jam inside printer mechanisms.

BRIEF SUMMARY OF THE INVENTION

The present invention overcomes the disadvantages of previously known mailer intermediates wherein a mailer intermediate is formed from a sheet having a transverse fold line dividing the sheet into a first panel and a second panel such that the first panel dimensions exceed the second panel dimensions. The sheet is folded along the transverse fold such that the second panel face is substantially flat against the first panel face. A temporary tacking agent is applied to the face of the sheet to releasably hold the second panel against the first panel adjacent to the folded over transverse edge. The mailer intermediate can now be processed in this pre-folded condition according to the user's variable imaging needs because there are no loose edges to catch on printer stacking trays. For example, a sheet fed laser printer is suitable for user variable imaging of the pre-folded mailer intermediate, even when the mailer intermediates are stacked in the output tray face up because the temporary tacking agent releasably holds the folded over edge. Preferably, the mailer intermediate is fed through the printing device such that the fold-over edge is the leading edge entering the printer. The mailer intermediate can also be fed into a printer using the edge opposite the fold-over edge as the leading edge. Finally, alternatively, either of the edges adjacent to the fold-over edge can suitably be used as the leading edge.

A portion of the longitudinal edges of the mailer intermediate may be permanently sealed, for example to form a return envelope. Sealing a portion of the longitudinal edges can occur either prior to printing, or may be accomplished later during processing through the folder/sealer equipment.

Sealing the longitudinal edges prior to printing is preferable if either longitudinal edge adjacent to the fold-over edge is to be used as the leading edge for printing. Once printed, the mailer intermediate may be further folded into additional panels including C-fold, Z-fold, or any other desired pattern.

In accordance with one aspect of the present invention, a mailer intermediate comprises a sheet having a sheet face, a pair of longitudinal edges, and a first transverse fold line dividing the sheet into a first panel and a second panel. The first panel has a first panel face, a first panel back, and a first transverse edge opposite the first transverse fold line. The second panel has a second panel face, a second panel back, and a second transverse edge opposite the first transverse fold line.

A quantity of tacking agent is applied to the sheet face such that when the sheet is folded along the first transverse fold line, the second panel is releasably held against the first panel adjacent to the second transverse edge by the quantity of tacking agent. In this pre-folded state, the mailer intermediate is suitable for processing through a variable imaging printer such as a sheet fed laser printer. Preferably, the tacking agent is a temporary tacking agent, for example, a repositionable adhesive. Alternatively, the tacking agent may be a permanent tacking agent. The tacking agent may either be applied to the second panel adjacent to the second transverse edge, or alternatively, the tacking agent may be applied to the first panel face such that when the sheet is folded about the first transverse fold line, and the second panel face is substantially flat against the first panel face, the second transverse edge is inhibited from lifting away from the first panel face. The second panel may optionally be sealed to the first panel adjacent to a portion of the pair of longitudinal edges forming a return envelope.

The mailer intermediate may further comprise a second transverse fold line dividing the first panel into an upper panel and a middle panel, wherein the second panel defines a lower panel, and the longitudinal dimensions of the middle panel exceed the longitudinal dimensions of the lower panel. A third traverse fold line divides the middle panel into an upper middle portion and a lower middle portion, and positioned such that, when the sheet is folded along the first transverse fold line, and the lower panel is substantially flat against the middle panel, the third transverse fold line is juxtaposed with the first traverse edge. A transverse line of weakening is scored across the upper middle portion defining a fold-over flap between the transverse line of weakening and the third transverse fold line, and a quantity of remoist glue is applied to the fold-over flap.

To fold and seal the mailer intermediate into a mailable piece, a transverse line of weakening is scored across the upper panel. A first transverse strip of adhesive is applied to the upper panel between the transverse line of weakening and the first transverse edge, and a plurality of transverse adhesive segments are applied to the lower panel back. The sheet is folded into a "C" pattern such that the face of the upper panel overlies the back of the lower panel. The first transverse strip of adhesive on the upper panel aligns substantially with the plurality of transverse segments on the lower panel back to seal the mailer closed for mailing. A pair of longitudinal tear strips may optionally be included adjacent to the pair of longitudinal edges. An adhesive is applied to the sheet face within the pair of longitudinal tear strips to secure the lower panel secured to the middle panel, and an adhesive applied to the lower panel back within the longitudinal tear strips to secure the face of the upper panel closed against the back of the lower panel.

A transverse line of weakening is scored in the lower, or second panel to define a zip strip between the transverse line of weakening and the second transverse edge. The zip strip is positioned to overlie the tacking agent when the sheet is folded along the first transverse fold line and the second panel is substantially flat against the first panel. The zip strip may further comprise a lift tab having a lift edge cut into the transverse line of weakening. Under this arrangement, the tacking agent is applied to the sheet face so as to avoid at least a portion of the zip strip adjacent to the lift edge. This allows the lift tab to be lifted easily by a user. As an alternative to a zip strip, a lift tab may be either formed from, or secured to the second panel. Where a lift tab is utilized in conjunction with a fold-over flap, the remoist glue on the fold-over flap is patterned to avoid the area of the lift tab when the fold-over flap is folded against the lower portion.

According to a second aspect of the present invention, a first sheet has a first sheet face, a pair of longitudinal edges, an upper transverse edge and a first transverse fold dividing the first sheet into a first panel and a second panel. A second sheet has a second sheet face, a pair of second sheet longitudinal edges, a second sheet upper transverse edge, and a second sheet lower transverse edge. The second sheet is superposed on the first sheet within the second panel, and the second sheet is sealed to the first sheet adjacent to one of the pair of longitudinal edges, adjacent to the second sheet upper transverse edge, and adjacent to the second sheet lower transverse edge, thus forming a return envelope.

Optionally, the second panel of the first sheet further comprises a longitudinal fold line defining a fold-over flap between the longitudinal fold line and one of the longitudinal edges. A longitudinal line of weakening is provided across the second sheet in register with the longitudinal fold line, and a strip of remoist glue is applied to the fold-over flap within the first sheet. A transverse line of weakening is provided along the first panel, and an adhesive is applied to the first panel between the transverse upper edge and the transverse line of weakening. A plurality of transverse adhesive segments are applied to the second sheet such that folding the first panel against the second sheet back, the transverse strip of adhesive on the first sheet face overlies the plurality of transverse adhesive segments on the second sheet back, to effectively seal the mailer closed. A pair of longitudinal tear strips adjacent to the pair of first sheet longitudinal edges are provided. Longitudinal strips of adhesive are applied within the pair of longitudinal tear strips such that the second sheet is further sealed to the first panel adjacent the pair of longitudinal tear strips thus forming a return envelope.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

It should be understood that, while the present invention will be described with respect to a C-fold mailer intermediate, this invention can be applied to other mailer intermediate configurations in which it is desired to print mailer intermediates using printers that incorporate stacking output trays or sheet feed input trays. Such a mailer configuration can comprise multiple parts including, but not limited to, fold-over pockets and flaps, as well as glued on pockets and flaps. Further, the descriptions provided herein are by way of illustration, and are not intended to be read as a limitation to practice the present invention. Also, Reference is made to FIGS. 1–6B, which illustrate mailer intermediate construction according to the present invention. It will be appreciated that these are diagrammatic figures, and that the dimensions are not shown to scale.

Figure 1A:
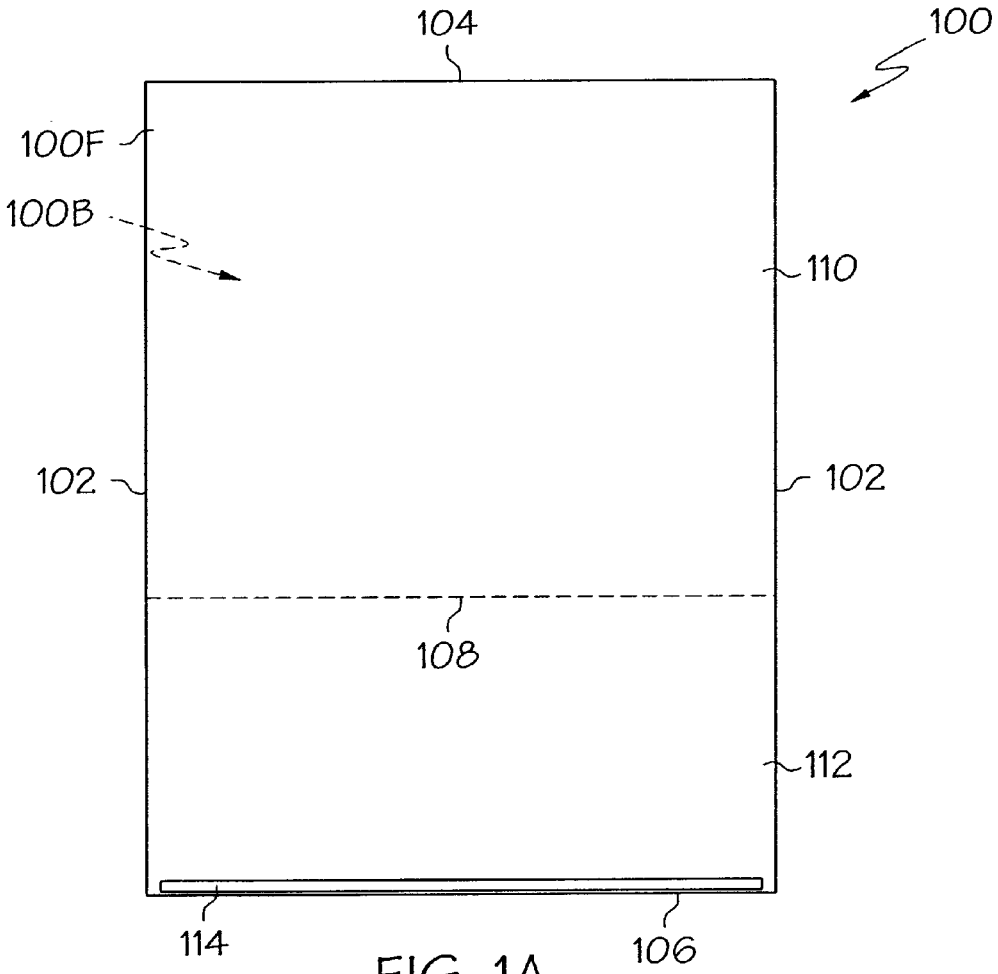
FIG. 1A is a plan view of the mailer intermediate according to the present invention, in an unfolded position.
Figure 1B:
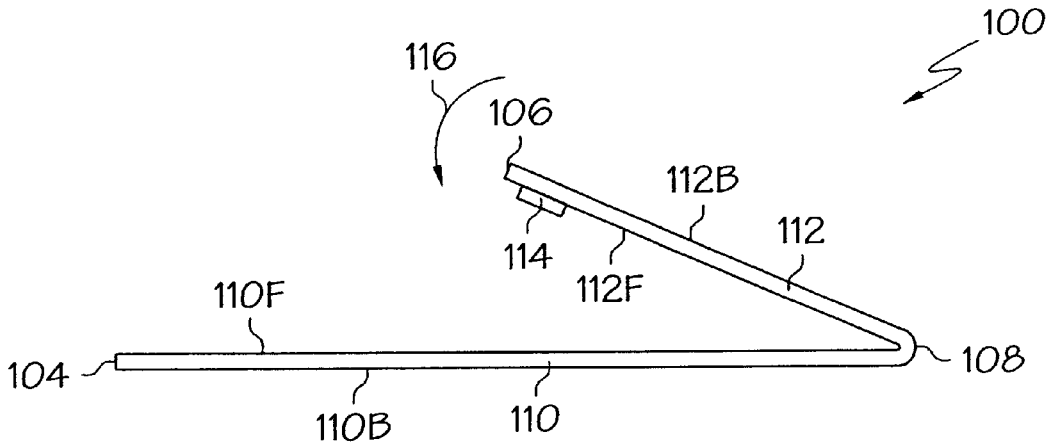
FIG. 1B is a diagrammatic view of the mailer intermediate of FIG. 1A as seen from an edge of the mailer intermediate, illustrating the second panel face being folded against the first panel face.

Referring to FIGS. 1A–1B, the mailer intermediate according to the first embodiment of the present invention is shown. The mailer intermediate is formed from a single sheet 100. The sheet 100 is generally rectangular and has a sheet face 100F, a sheet back 100B, a pair of longitudinal edges 102, a first transverse edge 104, and a second transverse edge 106. A first transverse fold line 108 divides the sheet 100 into a first panel 110 and a second panel 112. The first panel 110 has a first panel face 110F and a first panel back 110B. Additionally, the second panel 112 has a second panel face 112F and a second panel back 112B. A strip of temporary tacking agent 114 is applied to the second panel face 112F, adjacent to, and as close as possible to the second transverse edge 106. Referring to FIG. 1B, the second panel 112 is folded along the first transverse fold line 108 towards the first panel 110 in the direction of the first directional arrow 116. Upon completion of the fold, the second panel face 112F will be substantially flat against the first panel face 110F.

Figure 1C:
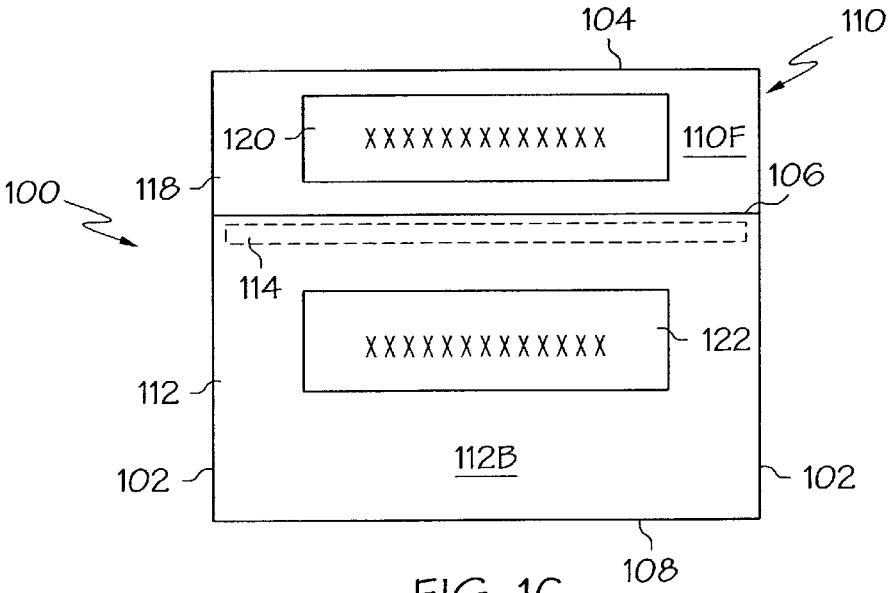
FIG. 1C is a plan view of the mailer intermediate of FIG. 1A in a folded position such that the second panel face is folded substantially flat against the first panel face, illustrating a folding pattern that may allow the mailer intermediate to receive user variable indicia on the first panel face and second panel back in a single pass through a printing device.

As shown in FIG. 1C, the second panel 112 is folded along the first transverse fold line 108 onto the first panel 110. The temporary tacking agent 114 is illustrated in dashed lines to indicate that it is actually positioned between the first and second panels 110, 112. The strip of temporary tacking agent 114 serves to releasably hold the second panel 112 to the first panel 110 adjacent to the second transverse edge 106. It should be appreciated by those skilled in the art that while the temporary tacking agent 114 is shown in FIGS. 1A–1B adjacent to the second transverse edge 106, the temporary tacking agent 114 may alternatively be applied to the first panel face 110F. The temporary tacking agent 114 should be positioned such that when the sheet 100 is folded along the first transverse fold line 108, and the second panel face 112F is substantially flat against the first panel face 110F, the second panel 112 adjacent to the second transverse edge 106 is releasably held against the first panel 110 by the temporary tacking agent 114.

The temporary tacking agent 114 can be any of a number of types of agents including repositionable adhesive, pressure seal adhesive, wet fugitive glue or lift dry adhesive. Further, the temporary tacking agent 114 is preferably a long, thin, continuous strip extending substantially the entire length of the second transverse edge 106. The temporary tacking agent 114 may be applied in any thickness to suit user requirements, so as to provide suitable holding. For example, the temporary tacking agent 114 may be a continuous strip extending substantially the entire length of the second transverse edge 106, and between ⅛" and ½" wide. As an alternative to a continuous strip, the temporary tacking agent 114 may be applied to the sheet 100 as a discontinuous line of segments or spots. This may be desirable to improve the ease of separating the second panel 112 adjacent to the second transverse edge 106 from the first panel face 110F. The strength of the temporary tacking agent 114 should be sufficiently weak to permit lifting of the second transverse edge 106 from the first panel face 110F without tearing the sheet 100.

As illustrated in FIG. 1C, the second panel back 112B, as well as an exposed portion 118 of the first panel face 110F may optionally be imaged at the same time, in a single pass. The temporary tacking agent 114 prevents the second transverse edge 106 from lifting from the sheet 100 during printing operations. As such, it should be observed that the temporary tacking agent 114 may be applied anywhere to sheet 100, to avoid a folded edge to otherwise cause a printer or other processing machine jam.

The sheet 100 is preferably fed into a printer using the first transverse fold line 108 as the leading edge. However, the first transverse edge 104, as well as either longitudinal edge 102 may be used as the leading edge. Further, it should be observed that sheet 100 can be printed using any of a number of printing systems including non-impact, sheet fed printers including laser and ink jet printers. The folded sheet 100 is suitable for simplex printing, and provides improved stacking in printer output trays, especially when stacked face up because the temporary tacking agent 114 prevents the second transverse edge 106 from interfering with the stacking of sheets in the output trays and becoming loose and catching on the feed mechanisms of printers. Further, printing of the sheet 100 in the folded condition allows the printing of first indicia 120 within the exposed portion 118 of the first panel face 110F, and second indicia 122 within the second panel back 112B in a single pass. It should be observed that the printing can occur on any portion of the second panel back 112B, or the exposed portion 118 of the first panel face 110F.

Figure 2A:
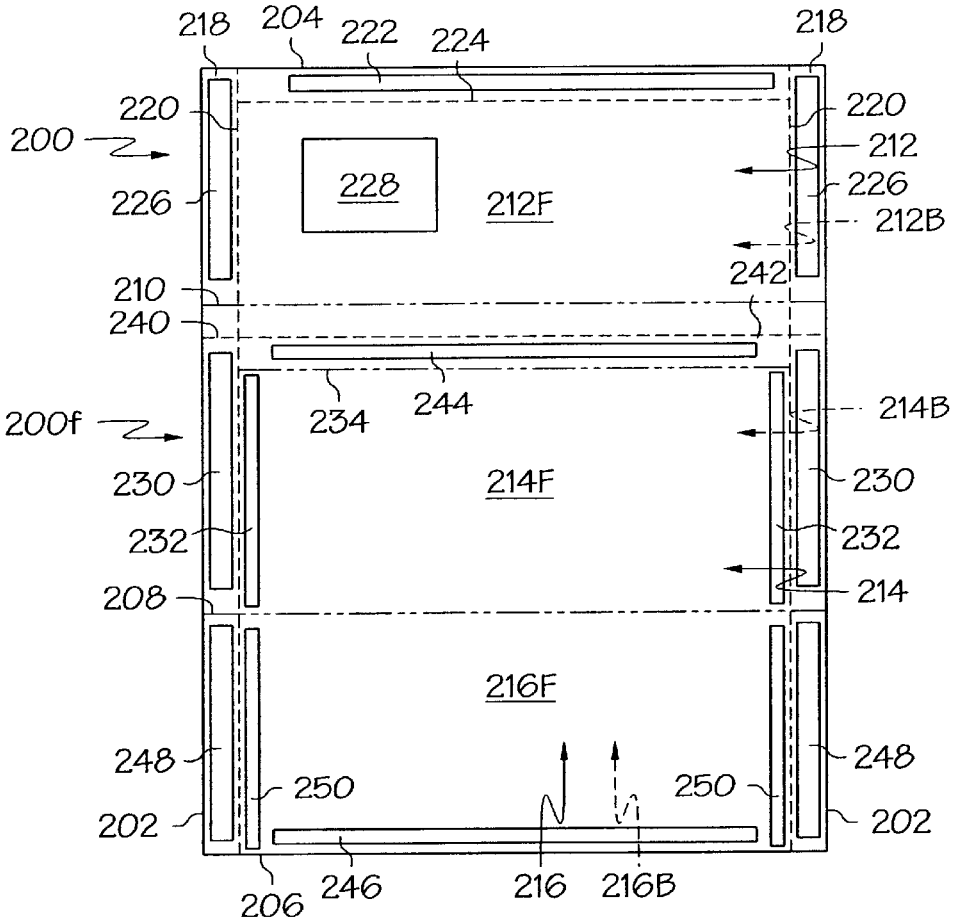
FIG. 2A is a plan view of the mailer intermediate according to a second embodiment of the present invention, illustrating the face of the mailer intermediate in an unfolded position.
Figure 2B:
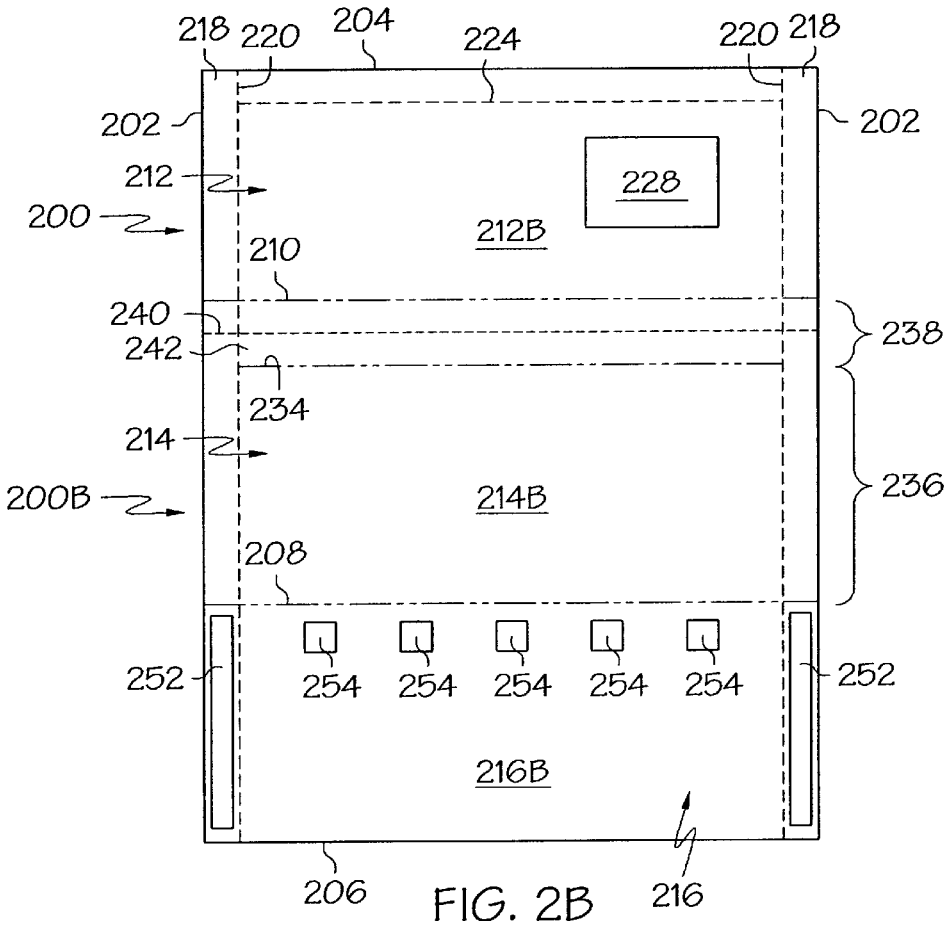
FIG. 2B is a plan view of the mailer intermediate according to FIG. 2A, illustrating the back of the mailer intermediate in an unfolded position.

Referring to FIG. 2A–2B, a second embodiment of the present invention is illustrated in an unfolded position where FIG. 2A illustrates a front view, while FIG. 2B illustrates a back view. The mailer intermediate is formed from a single sheet 200. The sheet 200 is generally rectangular and has a sheet face 200F, a sheet back 200B, a pair of longitudinal edges 202, a first transverse edge 204, and a second transverse edge 206. First and second transverse fold lines 208, 210 divide the sheet 200 into an upper panel 212, a middle panel 214, and a lower panel 216. The upper panel 212 has an upper panel face 212F and an upper panel back 212B. The middle panel 214 has a middle panel face 214F and a middle panel back 214B. The lower panel 216 has a lower panel face 216F and a lower panel back 216B. Tear strips 218 are optionally provided to facilitate easy opening of the mailer. The boundary between the longitudinal edges 202, and the longitudinal lines of weakening 220 define the tear strips 218.

The upper panel face 212F includes a first transverse strip of adhesive 222 applied adjacent to, and as close as possible to the first transverse edge 204. Optionally, a first transverse line of weakening 224 is provided adjacent to the first transverse strip of adhesive 222. Where the sheet 200 incorporates tear strips 218, first longitudinal strips of adhesive 226 may be provided on each of the tear strips 218 within the upper panel face 212F. Further, the upper panel 212 may optionally include a conventional window or transparentized window panel 228 for outgoing mail address, or other information. Any suitable window material can be used for this process. Alternatively, a portion of the upper panel 212 may be transparentized, as disclosed in commonly assigned U.S. Pat. No. 5,418,205 and incorporated herein by reference.

Figure 2C:
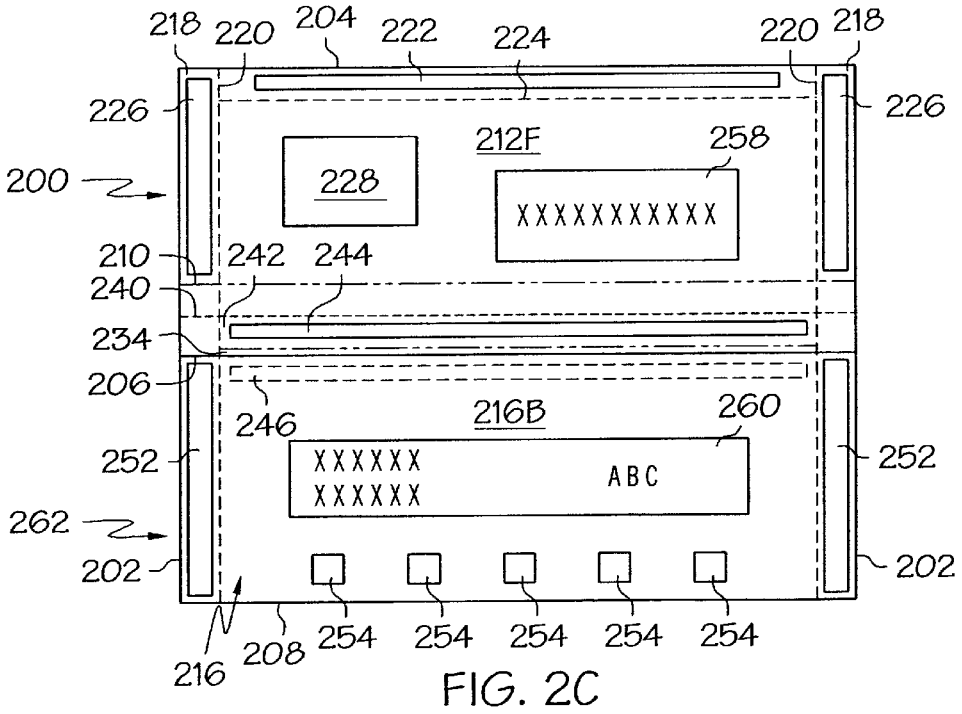
FIG. 2C is a plan view of the mailer intermediate of FIG. 2A in a folded position such that the lower panel face is folded substantially flat against the middle panel face, illustrating a folding pattern that may allow the mailer intermediate to receive user variable indicia on the upper panel face and lower panel back in a single pass through a printing device.
Figure 2D:
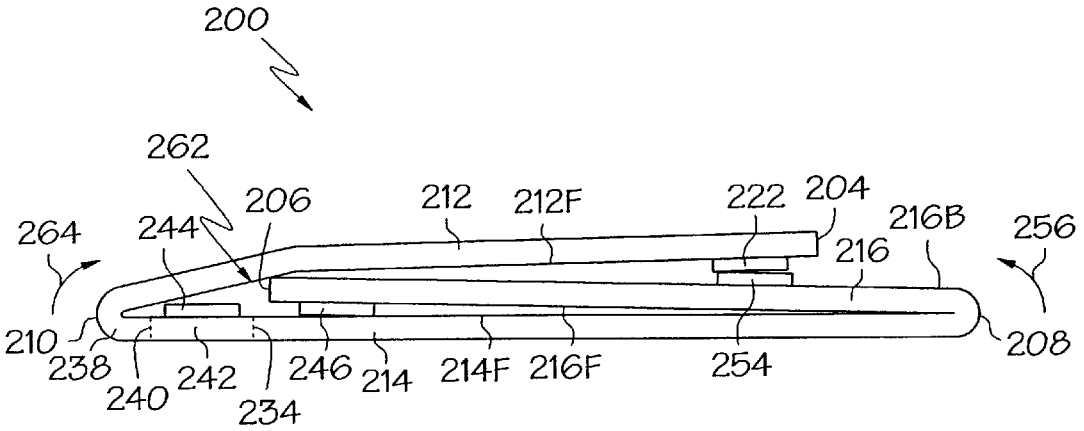
FIG. 2D is a diagrammatic view of the mailer intermediate of FIG. 2A as seen from an edge of the mailer intermediate, illustrating the mailer intermediate being folded into a "C"-fold mailer by folding the lower panel face substantially flat against the middle panel face, and folding the upper panel face substantially flat against the middle panel face and lower panel back.

The middle panel face 214F may include second longitudinal strips of adhesive 230 where the sheet 200 incorporates tear strips 218. The second longitudinal strips of adhesive 230 are provided on each of the tear strips 218 within the middle panel face 214F. Further, the middle panel face 214F includes third longitudinal strips of adhesive 232. The third longitudinal strips of adhesive 232 are positioned adjacent to the longitudinal lines of weakening 220 opposite the tear strips 218. As best illustrated in FIG. 2B, a third transverse fold line 234 divides the middle panel 214 into an lower middle portion 236 and an upper middle portion 238. Referring to FIG. 2D, the third transverse fold line 234 is positioned such that when the lower panel 216 is folded along the first transverse fold line 208, and the lower panel face 216F is substantially flat against the middle panel face 214F, the third transverse fold line 234 is juxtaposed with the second traverse edge 206. Referring to FIGS. 2A–2D, a second traverse line of weakening 240 is provided across the upper middle portion 238, defining a fold-over flap 242 in the area bound between the second transverse line of weakening 240 and the third transverse fold line 234. A strip of remoist glue 244 is applied to the middle panel face 214F within the area defining the fold-over flap 242. An example of a suitable strip of remoist glue 244 includes a remoist glue wherein the adhesive characteristics become activated once the glue is suitably wetted. Alternately, the remoist glue 244 could be positioned on lower panel 216B proximate the second transverse edge 206, and aligned so that when moistened, the glue would adhere to flap 242 when folded over at third transverse fold line 234. In this arrangement, the glue 244 and the temporary tacking agent on opposing faces would be preferably offset from one another to minimize compound thickness of adhesive proximate edge 206.

Referring to FIG. 2A, the lower panel face 216F includes a strip of temporary tacking agent 246 applied adjacent to, and as close as possible to the second transverse edge 206. Fourth longitudinal strips of adhesive 248 are provided on each of the tear strips 218 within the lower panel face 216F. Further, the lower panel face 216F includes fifth longitudinal strips of adhesive 250. The fifth longitudinal strips of adhesive 250 are positioned adjacent to the longitudinal lines of weakening 220 opposite the tear strips 218.

Referring to FIG. 2B, the backside of the sheet 200 is illustrated in an unfolded position. The lower panel back 216B includes sixth longitudinal strips of adhesive 252 where the sheet 200 incorporates tear strips 218. The sixth longitudinal strips of adhesive 252 are provided on the tear strips 218 within the lower panel back 216F. Further, the lower panel back 216F may optionally include a plurality of transverse adhesive segments254.

Referring to FIG. 2D, a C-fold mailer is formed from the sheet 200 by folding the lower panel 216 in the direction of first arrow 256. Upon completion of the fold, the lower panel face 216F is substantially flat against the middle panel face214F. The temporary tacking agent 246 secures the lower panel 216 to the middle panel 214 adjacent to the second transverse edge 206. The temporary tacking agent 246 is illustrated in FIG. 2C as dashed lines to indicate that the temporary tacking agent 246 is actually between the middle panel 214 and the lower panel 216. Referring to FIG. 2C, the sheet 200 may receive first indicia 258 printed within the upper panel face 212F, and second indicia 260 printed within the lower panel back 216B in a single pass through a printer. Printing of the sheet 200 is accomplished in the same manner as more fully described for the first embodiment herein.

Where the sheet 200 is to include a return envelope or pouch portion 262, the first transverse fold line 208 is positioned such that the longitudinal dimensions of the middle panel 214 are equal to, or exceed the longitudinal dimensions of lower panel 216. As best illustrated in FIG. 2A, to form the longitudinal edges of the return envelope 262, the lower panel 216 is permanently sealed to the middle panel 214 adjacent to a portion of the longitudinal edges 202 by third and fifth longitudinal strips of adhesive 232, 250. The third and fifth longitudinal strips of adhesive 232, 250 are positioned such that, upon folding the lower panel face 216F substantially flat against the middle panel face 214F, the third and fifth longitudinal strips of adhesive 232, 250 substantially align. Any type of adhesive can be used to seal the lower panel 216 to the middle panel 214 adjacent to a portion of the longitudinal edges 202. Examples of suitable adhesives are permanent adhesive, conventional wet glue, pressure seal adhesive including pressure sensitive adhesive, and cold temperature adhesive. Additionally, the third and fifth longitudinal adhesive strips of adhesive 232, 250 can be sealed either prior to printing, or later during processing through folder/sealer equipment. It should be appreciated by those skilled in the art that the either the third or fifth longitudinal strips of adhesive 232, 250 may be omitted, depending upon the type of adhesive used. Further, the return envelope 262 may be formed either prior to, or subsequent to user variable printing.

Where the sheet 200 includes tear strips 218, the second longitudinal strips of adhesive 230 are positioned to align with the fourth longitudinal strips of adhesive 248 when the lower panel face 216F is folded substantially flat against the middle panel face 214F. It should be observed that either the second or fourth longitudinal strips of adhesive 230, 248 may be omitted depending upon the type of adhesive selected. Further, the second and fourth longitudinal strips of adhesive 230, 248 may be sealed either prior to, or subsequent to user variable printing.

Referring to FIG. 2D, the upper panel 212 is folded along the second transverse fold line 210 in the direction of the second directional arrow 264, such that the upper panel face 212F lies against the middle panel face 214F, and the lower panel back 216B, thus forming a "C" shape. The plurality of transverse segments 254 of adhesive applied to lower panel back 216B align with the first transverse strip 222 of adhesive applied to the upper panel face 212F to secure the folded sheet 200 closed. It should be pointed out that the plurality of transverse segments 254 of adhesive may also be a continuous strip of adhesive depending upon user requirements. A suitable adhesive for the plurality of transverse segments 254 of adhesive may include a pressure sensitive cohesive adhesive, or a heat activated adhesive. Further, it should be observed that either the plurality of transverse segments 254 of adhesive applied to the lower panel back 216B, or the first transverse strip of adhesive 222 applied to the first panel face 212F, may be omitted, depending upon the selected adhesive. As best illustrated in FIG. 2C, where tear strips 218 are used, the first longitudinal strips of adhesive 226 on the upper panel face 212F align with, the sixth longitudinal strips of adhesive 252 on the lower panel back 216B when the upper panel face 212F is folded substantially flat against the lower panel back 216B. It should be observed that, depending upon the type of adhesive used for the first and sixth longitudinal strips of adhesive 226, 252, either adhesive may be omitted.

Referring to FIGS. 2A–2D, in use, to open a folded sheet 200, a user would remove the tear strips 218 by tearing along the longitudinal lines of weakening 220 to separate the tear strips 218 from the remainder of the sheet 200. This action further removes the first, second, fourth and sixth longitudinal strips of adhesive 226, 230, 248 and 252 provided to secure the sheet 200 sealed during mailing. The upper panel 212 is opened from the lower panel back 216B by breaking the adhesive bond between the plurality of transverse segments 254 on the lower panel back 216B, and the first transverse strip 222 of adhesive on the upper panel face 212F. Where the first transverse line of weakening 224 is provided, a user may tear along the first transverse line of weakening to separate the first transverse strip 222 of adhesive from the plurality of transverse segments 254 of adhesive. A user tears along the second transverse line of weakening 240 to separate return envelope 262 including the fold-over flap 242 from the remainder of the sheet 200. The temporary tacking agent 246 is broken, allowing the lower panel 216 adjacent to the second transverse edge 206 to be lifted away from the middle panel face 214F. The return envelope 262 may be stuffed with intended items. The fold-over flap 242 is folded along the third transverse fold line 234, such that the strip of remoist glue 244 seals fold-over flap 242 against the lower panel back 216B.

Figure 3:
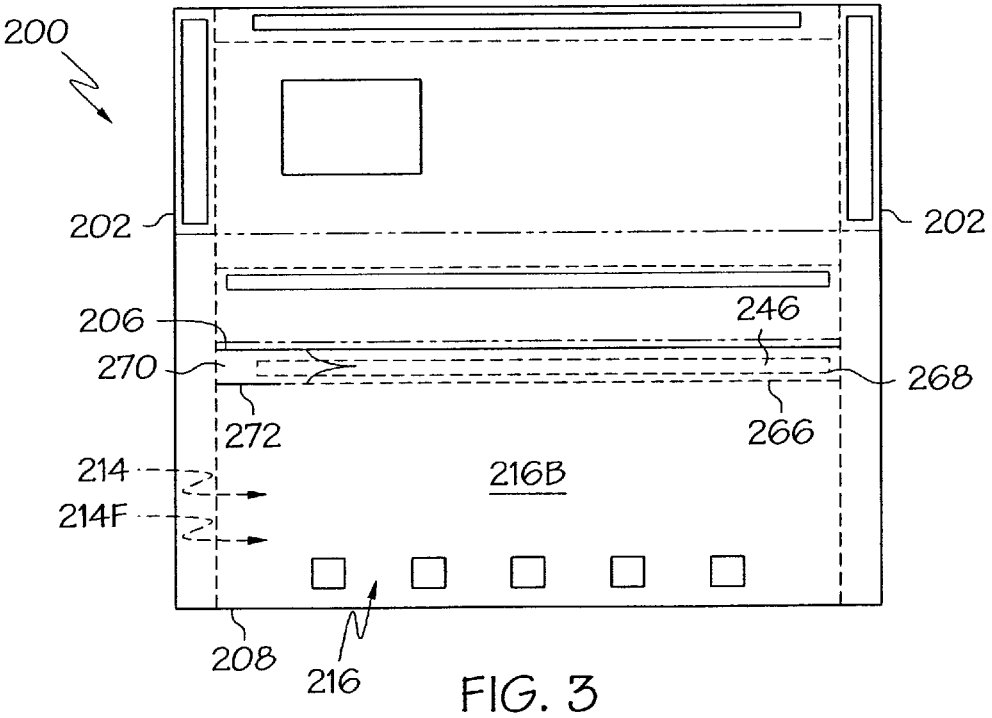
FIG. 3 is a plan view of the mailer intermediate according to a third embodiment of the present invention, which is identical to the mailer intermediate as illustrated in FIGS. 2A–2D, and additionally includes a zip strip to assist the user in opening the return envelope.

The embodiment in FIG. 3 includes structure identical to that of FIGS. 2A–2D, and as such, like structure is indicated with like reference numerals. Referring to FIG. 3, the sheet 200 is shown in a partially folded position such that the lower panel 216 is folded along the first transverse fold line 208 such that the lower panel face 216 is substantially flat against the middle panel face 214F. The temporary tacking agent 246 is illustrated in dashed lines to indicate that the temporary tacking agent 246 is actually between the middle panel 214 and the lower panel 216, adjacent to the second transverse edge 206. The lower panel 216 includes a third transverse line of weakening 266 such as a perforation, defining a zip strip 268 between the third transverse line of weakening 266, and the second transverse edge 206. The third transverse line of weakening 266 is positioned such that the zip strip 268 overlies the temporary tacking agent 246. A lift tab 270 is provided to assist a user in opening the zip strip 268. The lift tab 270 includes a lift edge 272, which is a cut such as a die cut, in the lower panel 216, along the third transverse line of weakening 266 to allow the lift tab 270 to be easily freed from the lower panel 216. For example, a transverse cut along the third transverse line of weakening 266, ¼ inch long, adjacent to one of the longitudinal lines of weakening 220 is a suitable construction for the lift edge 272. The lift edge 272 forms a boundary for the temporary tacking agent 246 such that no temporary tacking agent 246 resides underneath at least a portion of the lift tab 270. The lift tab 270 is pulled transversely across the lower panel 216 causing the lower panel 216 to tear along the third transverse line of weakening 266, removing the zip strip 268 from the remainder of the lower panel 216. Both the third transverse line of weakening 266, and temporary tacking agent 246 should be sufficiently weak to permit removal of the zip strip 268 without tearing the remainder of the sheet 200. In use, a pencil, finger or the like, is inserted into the lift edge272, and slid along the sheet 200 transversely to tear the zip strip 268. Alternatively, a user may grasp the lift tab 270 and pull transversely across the sheet 200 to remove the zip strip 268.

Figure 4:
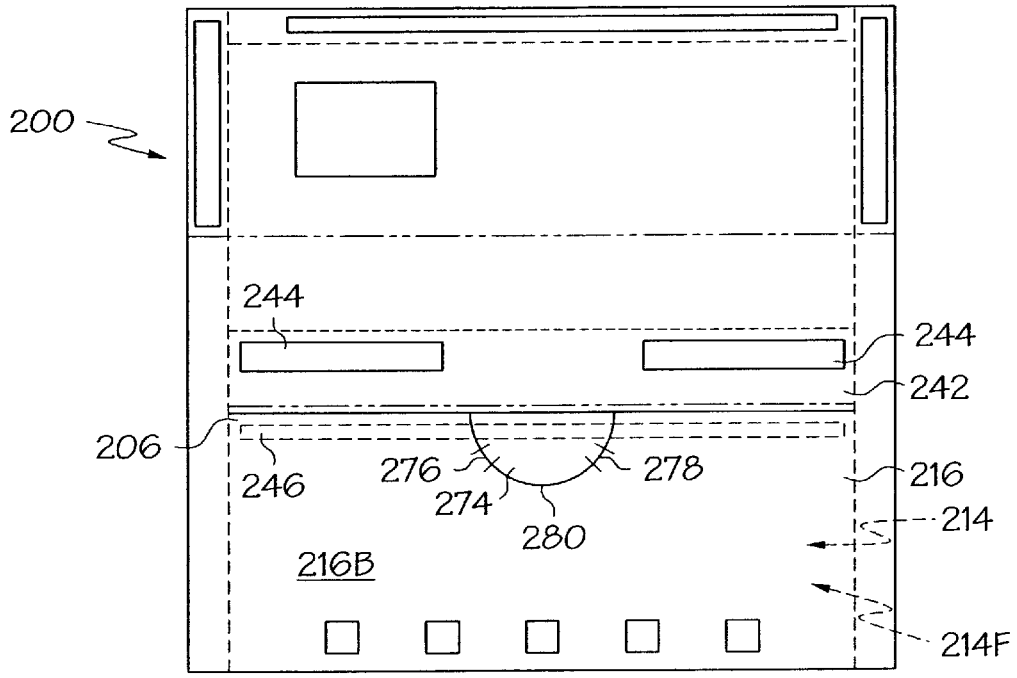
FIG. 4 is a plan view of the mailer intermediate according to a fourth embodiment of the present invention, which is identical to the mailer intermediate as illustrated in FIGS. 2A–2D, and additionally includes a lift tab to assist the user in opening the return envelope.

The embodiment in FIG. 4 includes structure identical to that of FIGS. 2A–2D, and as such, like structure is indicated with like reference numerals. Referring to FIG. 4, the sheet 200 is shown in a partially folded position such that the lower panel 216 is folded substantially flat against the middle panel face 214F. The temporary tacking agent 246 is illustrated in dashed lines to indicate that the temporary tacking agent 246 is actually between the lower panel 216 and the middle panel 214, adjacent to the second transverse edge 206.

A lift tab 274 is provided to assist the user in breaking the bond created by the temporary tacking agent 246 thus allowing the user to separate the lower panel 216 from the middle panel 214 adjacent to the second transverse edge 206. The lift tab 274 is formed in the lower panel 216 by a line of weakening 276. The lift tab 274 overlies at least a portion of the temporary tacking agent 246, and extends into the lower panel 216 removed from the temporary tacking agent 246. The line of weakening 276 can be comprised of spaced ties 278, perforations, or other techniques arranged to allow the lift tab 274 to be torn from the lower panel 216. A lift edge 280 is die cut in the line of weakening 276 in a portion of the line of weakening 276 not overlying the temporary tacking agent 246. The lift edge 280 should be dimensioned to allow a user to grasp hold of the lift tab 274. In use, the lift edge 280 is lifted away from the lower panel 216, and the lift tab 274 is torn along the line of weakening 276 such that the lift tab 274 is torn from the lower panel 216. Both the line of weakening 276, and temporary tacking agent 246 should be sufficiently weak to permit removal of the lift tab 274 without tearing the remainder of the sheet 200. Once the lift tab 274 is removed from the sheet 200, a pencil, finger or the like, may be inserted between the middle and lower panels 214, 216, and slid along the second transverse edge 206. It should be appreciated that while the lift tab 274 is formed from a line of weakening 276 as illustrated, the lift tab 274 may optionally comprise a glued on or otherwise secured tab. Further, while the lift tab 274 is shown generally centered on the lower panel 216 adjacent to the second transverse edge 206, the lift tab 274 may be formed offset from the center of the sheet 200. The strip of remoist glue 244 is patterned to avoid adhesive falling in the area of lift tab 274, while allowing for permanently sealing the fold-over flap 242 against the lower panel back 216B.

Figure 5A:
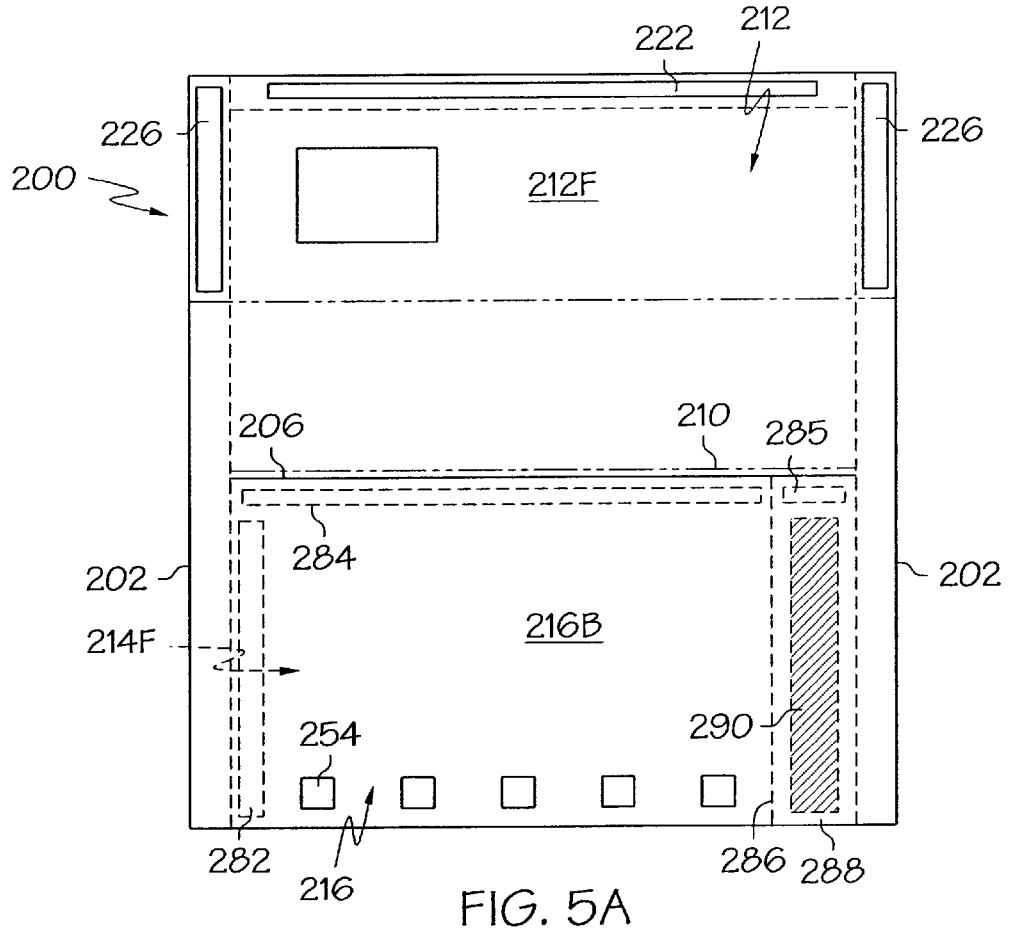
FIG. 5A is a plan view of the mailer intermediate according to a fifth embodiment of the present invention, illustrated in a partially folded position, which is similar to the mailer intermediate as illustrated in FIGS. 2A–2D except that fold-over-flap is formed longitudinally.
Figure 5B:
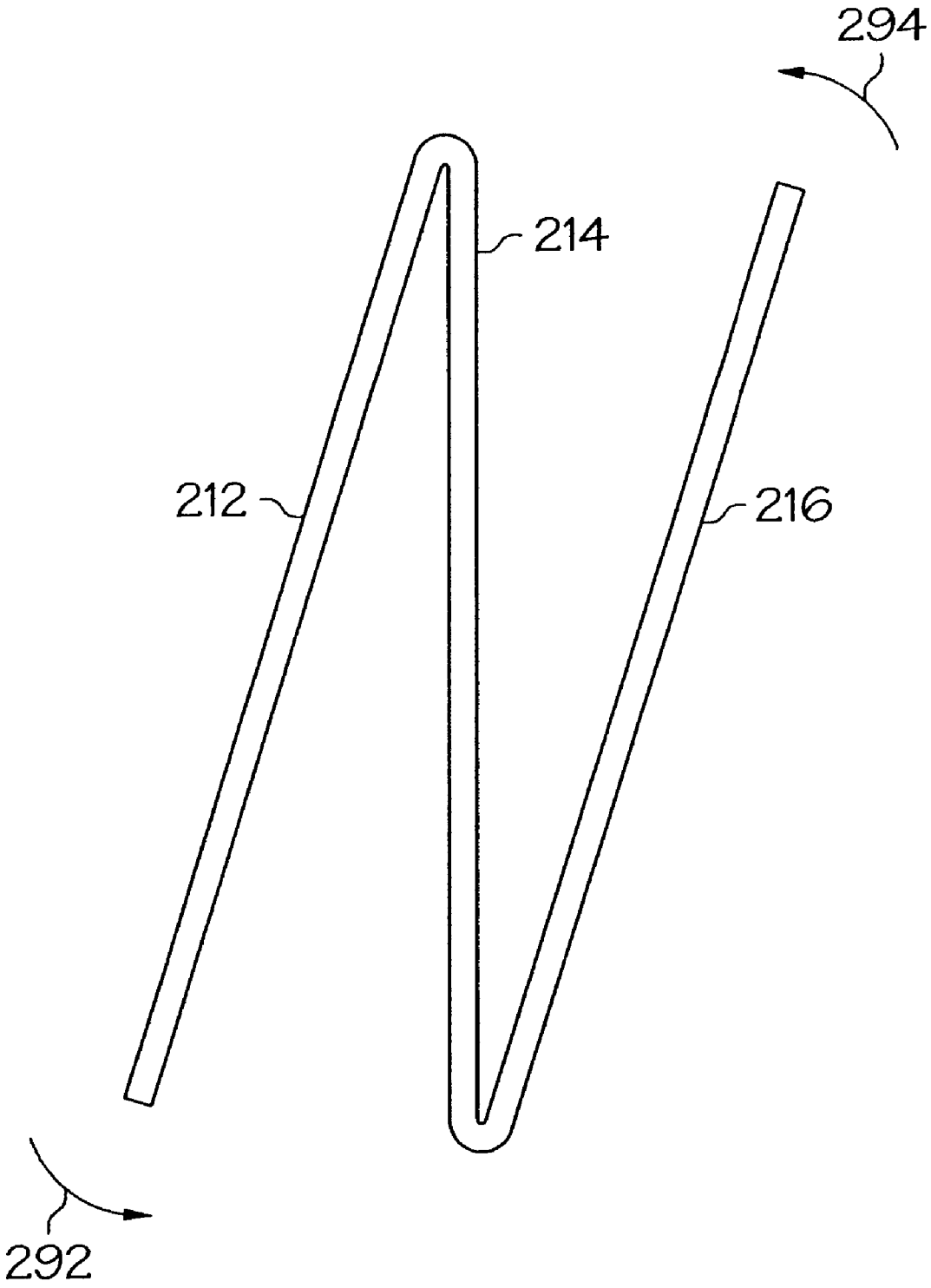
FIG. 5B is a diagrammatic view of the mailer intermediate of FIG. 5A as seen from an edge of the mailer intermediate, illustrating the mailer intermediate being folded into a "Z"-fold mailer by folding the lower panel face substantially flat against the middle panel face, and folding the upper panel back substantially flat against the middle panel back.

The embodiment in FIG. 5A includes structure identical to that of FIGS. 2A–2D, and as such, like structure is indicated with like reference numerals. Referring to FIG. 5A, the sheet 200 is shown in a partially folded position with the lower panel 216 folded substantially flat against the middle panel face. The lower panel 216 is permanently glued to the middle panel 214 adjacent to either one of the longitudinal edges 202 by a first permanent glue strip 282, and adjacent to the second transverse edge 206 by second permanent glue strip 284 and temporary tacking strip 285. The first and second permanent glue strips 282, 284, and temporary tacking strip 285 are actually positioned between the lower panel 216 and the middle panel 214, thus are illustrated in dashed lines. The second permanent glue strip 284 and the temporary tacking strip 285 prevent the second transverse edge 206 from lifting. The sheet 200 is suitable for printing in this folded position using laser printers and other imaging devices as more fully described herein. The second transverse fold line 210 may optionally be scored with a line of weakening to allow a user to easily separate the upper panel 212 from the remainder of the sheet. The lower panel 216 includes a second longitudinal line of weakening 286 defining a zip strip 288 between the second longitudinal line of weakening 286, and the longitudinal edge 202. A strip of remoist glue 290 is provided on middle panel face 214F overlain by the zip strip 288. The strip of remoist glue 290 is shown shaded with diagonal lines to indicate that the strip of remoist glue is actually between the middle and lower panels 214, 216. It should be observed that other features described herein, including tear strips, zip strips, lift tabs, additional lines of weakening, transparentized windows, and the like, can be incorporated into this embodiment. To fold the sheet 200 into a mailable piece, the lower panel 216 is folded against the middle panel 214, and the upper panel face 212F is folded against the lower panel back 216B, to form a C-fold. When the fold is completed, and the upper panel face 112F is flat against the lower panel back 116B, the first transverse strip of adhesive 222 contacts the plurality of transverse adhesive segments 254, and the first longitudinal strips of adhesive 226 contact the lower panel back 216B within the tear strips 218 to hold the sheet 100 closed. Referring to FIG. 5B, to fold the sheet 200 into a mailable piece, the upper panel 212 is folded against the middle panel 214 in the direction of the directional arrow 292, and the lower panel 216 is folded against the middle panel 214 in the direction of directional arrow 294, to form a fan fold or Z-fold. It should be observed that under this arrangement, the first transverse strip of adhesive 222, and the first longitudinal strips of adhesive 226 would be located on the upper panel back (not shown), while the plurality of transverse adhesive segments 254 would be located on the middle panel back 214B (not shown).

Figure 6A:
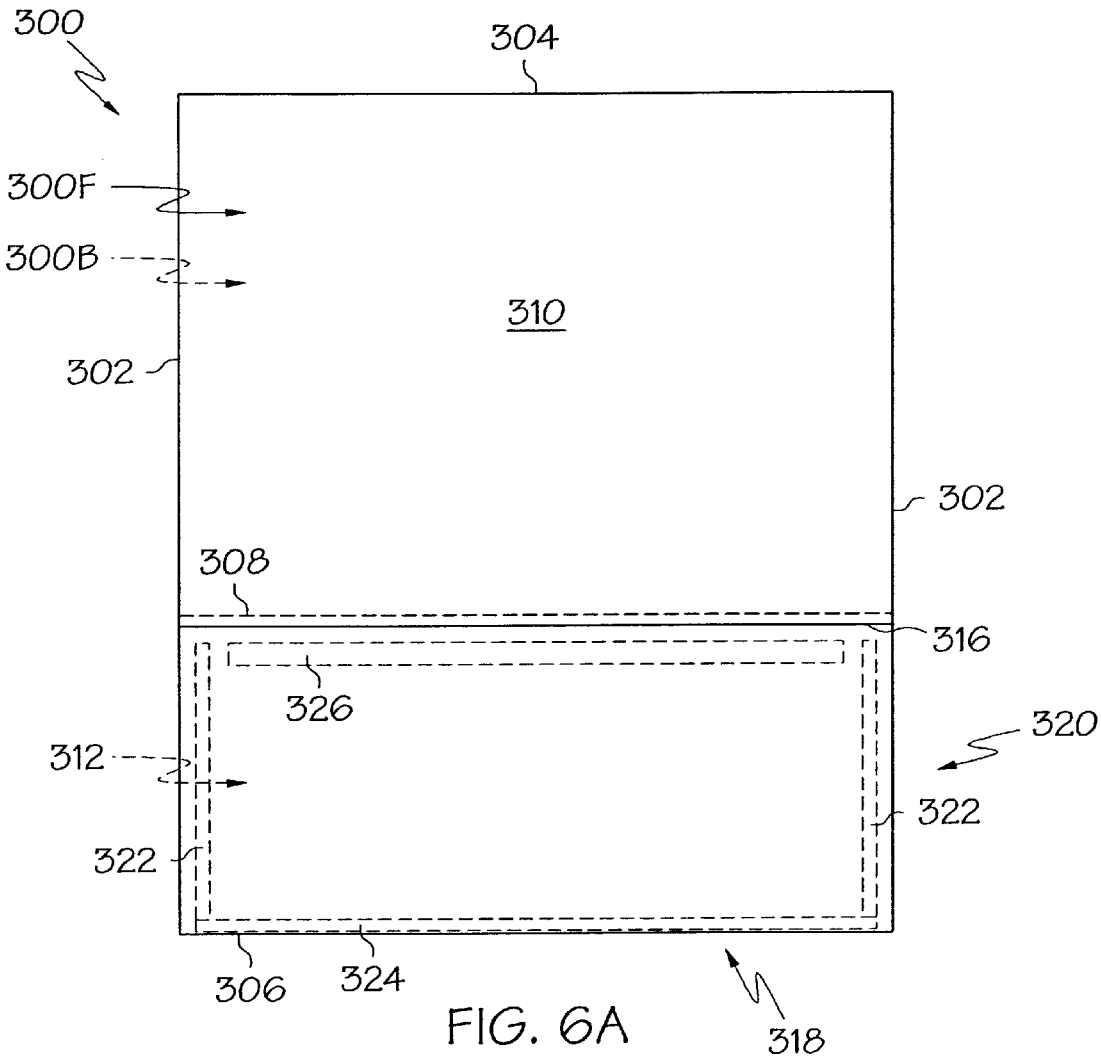
FIG. 6A is a plan view of the mailer intermediate according to a sixth embodiment of the present invention, which is similar to the mailer intermediate as illustrated in FIGS. 2A–2D except that return envelope is formed from a second sheet glued to the first sheet; and, FIG. 6B is a diagrammatic view of the mailer intermediate of FIG. 6A as seen from an edge of the mailer intermediate, illustrating the second sheet glued to the first sheet.
Figure 6B:
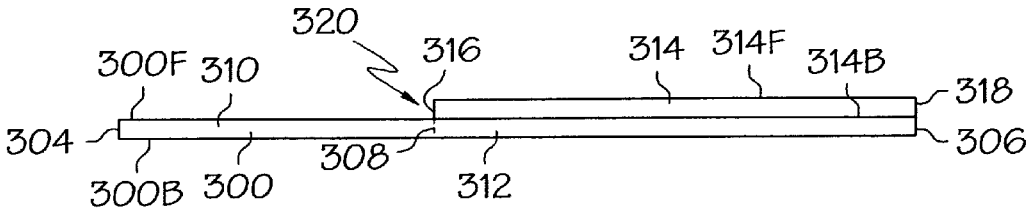

Referring to FIGS. 6A–6B, the sixth embodiment is illustrated. A first sheet 300 has a first sheet face 300F, a first sheet back 300B, a pair of longitudinal edges 302, an upper transverse edge 304, a lower transverse edge 306, and a first transverse fold line 308 dividing the first sheet into a first panel 310 and second panel 312. A second sheet 314 has a second sheet face 314F, a second sheet back 314B, an upper transverse edge 314 and a lower transverse edge 318. The second sheet 314 overlies, and is secured to the first sheet 300 within the second panel 312, forming a return envelope 320 therebetween. Specifically, longitudinal strips 322 of adhesive secure the second sheet 314 to the second panel 312 of the first sheet 300 adjacent to the longitudinal edges 302, and transverse strip 324 of adhesive secures the second sheet 314 to the second panel 312 of the first sheet 300 adjacent to the second transverse edge 306. Temporary tacking agent 326 is applied between the first sheet 300 and the second sheet 314 such that the second sheet 314 is releasably held to the first sheet face 300F adjacent to the second sheet upper transverse edge 316. This construction alleviates concerns over glue patterns being in the way of plow folding. It also permits running the sheets 300, 314 during manufacture, either in the portrait or landscape position. It should be observed that the sixth embodiment is otherwise identical to the other embodiments described herein. As such, features and construction techniques described herein, including but not limited to zip strips, lift tabs, tear strips, fold-over flaps, transparentized windows and the like are equally applicable to the sixth embodiment.

Having described the invention in detail and by reference to preferred embodiments thereof, it will be apparent that modifications and variations are possible without departing from the scope of the invention defined in the appended claims.

What is claimed is:

1. A mailer intermediate comprising:

a sheet having a sheet face, a pair of longitudinal edges, and a first transverse fold line dividing said sheet into a first panel and a second panel;

said first panel having a first panel face, a first panel back, and a first transverse edge opposite said first transverse fold line;

said second panel having a second panel face, a second panel back, and a second transverse edge opposite said first transverse fold line;

a repositionable adhesive applied to said sheet face, wherein said sheet is folded along said first transverse fold line such that said second panel is releasably held against said first panel adjacent to said second transverse edge by said repositionable adhesive; and, indicia applied to said sheet using a variable imaging printer while said second panel is releasably held to said first panel by said repositionable adhesive.

2. A mailer intermediate according to claim 1, wherein said sheet is folded along said first transverse fold line such that said second panel is substantially flat against said first panel, and said second panel is permanently sealed to said first panel adjacent to a portion of said pair of longitudinal edges such that an envelope is defined between said first and second panels.

3. A mailer intermediate according to claim 1, wherein said variable imaging printer is a laser printer.

4. A mailer intermediate according to claim 1, wherein said sheet further comprises a second transverse fold line dividing said first panel into an upper panel and a middle panel, wherein said second panel defines a lower panel, and the longitudinal dimensions of said middle panel exceed the longitudinal dimensions of said lower panel.

5. A mailer intermediate according to claim 4, wherein the longitudinal dimensions of said middle panel are equal to, or exceed the longitudinal dimensions of said upper panel.

6. A mailer intermediate according to claim 4, further comprising:

a third traverse fold line dividing said middle panel into an upper middle portion and a lower middle portion, and positioned such that, when said sheet is folded along said first transverse fold line, and said lower panel is substantially flat against said middle panel, said third transverse fold line is juxtaposed with said second traverse edge;

a transverse line of weakening scored across said upper middle portion defining a fold-over flap between said transverse line of weakening and said third transverse fold line; and, a quantity of remoist glue applied to said fold-over flap.

7. A mailer intermediate according to claim 4, wherein said lower panel further comprises a lift tab defined by at least a portion of said lower panel, said lift tab separable from the remainder of said lower panel, and wherein said remoist glue is patterned to avoid the portion of said lower panel defining said lift tab when said fold-over flap is folded against said lower panel.

8. A mailer intermediate according to claim 4, further comprising:

a transverse line of weakening scored across said upper panel;

a first transverse strip of adhesive applied to said upper panel between said transverse line of weakening and said first transverse edge; and, a plurality of transverse adhesive segments applied to said lower panel back.

9. A mailer intermediate according to claim 4, wherein said upper panel further includes a transparentized window.

10. A mailer intermediate according to claim 4, further comprising:

a pair of longitudinal tear strips adjacent to said pair of longitudinal edges;

an adhesive applied to said sheet face within said pair of longitudinal tear strips; and, an adhesive applied to said lower panel back within said longitudinal tear strips.

11. A mailer intermediate according to claim 1, wherein said second panel further comprises a lift tab.

12. A mailer intermediate according to claim 11, wherein said lift tab comprises a line of weakening forming a tab shape along said second panel adjacent to said second transverse edge, and a lift edge die cut into said line of weakening along a portion of said line of weakening so as to avoid said tacking agent.

13. A mailer intermediate according to claim 11, wherein said lift tab comprises a line of weakening forming a tab shape along said second panel adjacent to said second transverse edge, and a lift edge die cut into said line of weakening along a portion of said line of weakening so as to avoid said repositionable adhesive.

14. A mailer intermediate according to claim 1, further comprising printed indicia on said first panel face and said second panel back.

15. A mailer intermediate according to claim 1, wherein said repositionable adhesive comprises a discontinuous strip of segments of repositionable adhesive.

16. A mailer intermediate according to claim 1, wherein said repositionable adhesive is applied to said second panel adjacent to said second transverse edge.

17. A mailer intermediate comprising:

a sheet having a sheet face, a pair of longitudinal edges, and a first transverse fold line dividing said sheet into a first panel and a second panel;

said first panel having a first panel face, a first panel back, and a first transverse edge opposite said first transverse fold line;

said second panel having a second panel face, a second panel back, and a second transverse edge opposite said first transverse fold line;

a quantity of a temporary tacking agent applied to said sheet face in a continuous strip of temporary tacking agent, wherein said sheet is folded along said first transverse fold line such that said second panel is releasably held against said first panel adjacent to said second transverse edge by said quantity of temporary tacking agent; and indicia applied to said sheet using a variable imaging printer while said second panel is releasably held to said first panel by said quantity of temporary tacking agent.

18. A mailer intermediate according to claim 17, wherein said tacking agent is applied to said sheet in a strip having a width of substantially between ⅛ inch and ½ inch.

19. A mailer intermediate according to claim 17, wherein said second panel is sealed to said first panel adjacent to a portion of said pair of longitudinal edges forming a return envelope.

20. A mailer intermediate according to claim 17, wherein said tacking agent is applied to said second panel adjacent to said second transverse edge.

21. A mailer intermediate according to claim 17, wherein said continuous strip of temporary tacking agent spans substantially the entire length of said sheet.

22. A mailer intermediate according to claim 17, wherein said continuous strip of temporary tacking agent comprises a continuous strip of repositionable adhesive.

23. A mailer intermediate comprising:

a sheet having a sheet face, a pair of longitudinal edges, and a first transverse fold line dividing said sheet into a first panel and a second panel;

said first panel having a first panel face, a first panel back, and a first transverse edge opposite said first transverse fold line;

said second panel having a second panel face, a second panel back, and a second transverse edge opposite said first transverse fold line;

a quantity of a temporary tacking agent applied to said sheet face in a discontinuous strip of segments of temporary tacking agent that span substantially the entire width of said sheet, wherein said sheet is folded along said first transverse fold line such that said second panel is releasably held against said first panel adjacent to said second transverse edge by said quantity of temporary tacking agent; and indicia applied to said sheet using a variable imaging printer while said second panel is releasably held to said first panel by said quantity of temporary tacking agent.

24. A mailer intermediate according to claim 23, further comprising:

a pair of longitudinal tear strips adjacent to said pair of longitudinal edges; and, an adhesive applied to said sheet within said pair of longitudinal tear strips, wherein said discontinuous strip of segments of temporary tacking agent spans substantially the entire width of said sheet between and up to said longitudinal tear strips.

25. A mailer intermediate comprising:

a sheet having a sheet face, a pair of longitudinal edges, and a first transverse fold line dividing said sheet into a first panel and a second panel;

said first panel having a first panel face, a first panel back, and a first transverse edge opposite said first transverse fold line;

said second panel having a second panel face, a second panel back, and a second transverse edge opposite said first transverse fold line;

a quantity of a temporary tacking agent applied to said sheet face, wherein said sheet is folded along said first transverse fold line such that said second panel is releasably held against said first panel adjacent to said second transverse edge by said quantity of temporary tacking agent;

a transverse line of weakening in said second panel defining a zip strip between said transverse line of weakening and said second transverse edge, said zip strip positioned to overlie said temporary tacking agent when said sheet is folded along said first transverse fold line and said second panel is substantially flat against said first panel; and, indicia applied to said sheet using a variable imaging printer while said second panel is releasably held to said first panel by said quantity of temporary tacking agent.

26. A mailer intermediate according to claim 25, wherein:

said zip strip further comprises a lift tab having a lift edge cut into said transverse line of weakening, and, said tacking agent is applied to said sheet face so as to avoid at least a portion of said zip strip adjacent to said lift edge.

27. A C-fold mailer comprising:

a generally rectangular sheet having a sheet face, first and second transverse edges, a pair of longitudinal edges, and first and second transverse fold lines dividing said sheet into an upper panel, a middle panel, and a lower panel;

a third transverse fold line positioned across said middle panel;

said upper panel having an upper panel face and an upper panel back;

said middle panel having a middle panel face, a middle panel back and at least a portion of said middle panel defining a fold over flap;

said lower portion having a lower panel face and a lower panel back;

said lower panel being folded along said first transverse fold line such that said lower panel face is substantially flat against said middle panel face and said third transverse fold line is juxtaposed with said second transverse edge;

a quantity of temporary tacking agent applied to said sheet face such that said lower panel is releasably held to said middle panel adjacent to said second transverse edge;

said upper panel being folded along said second transverse fold line such that said upper panel face is substantially flat against said lower panel back; and, a strip of adhesive applied between said upper panel face and said lower panel back.

28. A C-fold mailer according to claim wherein said lower panel is permanently secured to said middle panel along a portion of said pair of longitudinal edges.

29. A C-fold mailer according to claim 27 further comprising longitudinal tear strips.

30. A C-fold mailer according to claim 27, wherein said lower panel further comprises a zip strip, said zip strip positioned to overlie said temporary tacking agent.

31. A C-fold mailer according to claim 30, wherein said zip strip further comprises a lift tab having a lift edge, and wherein said temporary tacking agent is applied to said sheet face so as to avoid at least a portion of said lift tab.

32. A C-fold mailer according to claim 27, wherein said lower panel further comprises a lift tab.

33. A C-fold mailer according to claim 27, wherein said lower panel further comprises a lift tab defined by at least a portion of said lower panel, said lift tab separable from the remainder of said lower panel, and said fold-over flap further comprises remoist glue patterned to avoid the portion of said lower panel defining said lift tab when said fold-over flap is folded against said lower panel.

34. A C-fold mailer according to claim 27, further comprising indicia applied to said sheet using a variable imaging printer while said second panel is releasably held to said first panel by said quantity of temporary tacking agent.

* * * * *

UNITED STATES PATENT AND TRADEMARK OFFICE

CERTIFICATE OF CORRECTION

PATENT NO. : 6,409,075 B1
DATED : June 25, 2002
INVENTOR(S) : Mehta et al.

It is certified that error appears in the above-identified patent and that said Letters Patent is hereby corrected as shown below:

Column 4,
Line 37, reads “fold-over-flap” should read -- fold-over flap --

Column 12,
Line 18, reads “a third traverse” should read -- a third transverse --
Line 24, reads “second traverse” should read -- second transverse --
Line 31, reads “claim 4” should read -- claim 6 --

Column 15,
Line 11, “claim wherein” should read -- claim 27, wherein --

Signed and Sealed this

Twelfth Day of November, 2002

*Attest:*

*Attesting Officer*

JAMES E. ROGAN
*Director of the United States Patent and Trademark Office*